US005911535A

United States Patent [19]

Gvoich

[11] Patent Number: 5,911,535

[45] Date of Patent: Jun. 15, 1999

[54] MULTIPURPOSE THIGH/HIP/ABDOMINAL EXERCISER

[75] Inventor: Ned Gvoich, Scottsdale, Ariz.

[73] Assignee: Kor-One, Ltd, Scottsdale, Ariz.

[21] Appl. No.: 09/033,931

[22] Filed: Mar. 3, 1998

[51] Int. Cl.[6] ..... A63B 21/02

[52] U.S. Cl. ..... 402/124; 482/126

[58] Field of Search ..... 482/121, 122, 482/124, 126, 128

[56] References Cited

U.S. PATENT DOCUMENTS

| | | |
|---|---|---|
| 1,638,003 | 8/1927 | Neumann . |
| 2,930,614 | 3/1960 | McIntosh . |
| 4,349,194 | 9/1982 | Lambert . |
| 4,720,096 | 1/1988 | Rogers . |
| 5,267,929 | 12/1993 | Chen . |
| 5,399,138 | 3/1995 | Jones . |
| 5,462,508 | 10/1995 | Schiavone . |
| 5,480,367 | 1/1996 | Bergman . |
| 5,484,368 | 1/1996 | Chang . |
| 5,507,712 | 4/1996 | Chang . |
| 5,547,446 | 8/1996 | Szabo . |
| 5,549,532 | 8/1996 | Kropp . |
| 5,637,066 | 6/1997 | Chang . |
| 5,651,755 | 7/1997 | Chen . |
| 5,665,040 | 9/1997 | Ho . |
| 5,674,164 | 10/1997 | Kravitz . |
| 5,697,873 | 12/1997 | Van Straaten . |
| 5,700,232 | 12/1997 | Clausen . |

*Primary Examiner*—Lynne A. Reichard
*Attorney, Agent, or Firm*—John D. Titus; Bryan Cave LLP

[57] ABSTRACT

A multipurpose exercise device comprises a pair of side members each having a concave surface adapted to engage one of the thighs of a user. Each of the side members is supported in sliding engagement by a corresponding frame and operatively attached to a resilient member that urges the side member toward the open side of the concave surface. The frames can be fixed in various orientations. In one orientation of the frames, the side members face each other with the concave surfaces both opening inward. The user's legs are placed between the side members and moved apart against the urging of the resilient members to exercise the thigh abductor muscles. IN another orientation, the frames are oriented so that the side member face away from each other with the concave surfaces both opening outward. The device is placed between the user's legs and the user moves his/her legs together against the urging of the resilient members to exercise the thigh adductor muscles. In yet another orientation, the frames are oriented so that the side members are parallel and facing the same direction. The device in this configuration may be laid over the user's thighs with one side member resting on each thigh. A hip flexor exercise may be performed by lifting one leg at a time against the corresponding side member or the muscles of the abdomen may be exercised by bending forward to move the frames against the side members.

17 Claims, 6 Drawing Sheets

MULTIPURPOSE THIGH/HIP/ABDOMINAL EXERCISER

BACKGROUND OF THE INVENTION

The present invention relates to exercising apparatus in general and to a portable exercise device in particular.

In any good exercise regimen, attention must be given to toning of the muscles of the lower abdomen and thighs. To tone this area, health clubs generally offer a different machine for each of the hip abductor, hip abductor, hip flexion, hip extension, and lower abdominal muscles. Recognizing the prohibitive cost of providing a separate machine for each of these muscles for at-home use, exercise equipment suppliers have attempted with varying degrees of success to provide combination exercise devices for the home exercise market. U.S. Pat. No. 5,480,367 discloses a combination abductor/abductor exercise device, however, this device does not provide for exercising the abdominal muscles or the hip extensor/flexor muscles. U.S. Pat. No. 5,507,712 discloses a multipurpose exercising apparatus configurable to exercise the abductor and abductor muscles of the thigh, and certain chest muscles. Again, however, the device is not configurable to exercise the abdomen or hip flexor muscles. U.S. Pat. No. 5,232,425 discloses an exercise device sold commercially as the EZ KRUNCH® exercise device. This device exercises the abdomen and the thigh abductor muscles, which are used to hold the device in place, however, the abductor muscles are exercised isometrically and no provision is made for exercising the thigh abductor muscles.

Accordingly, what is needed is a portable exercise device suitable for at-home or health club use that is suitable for exercising all of the thigh abductor, thigh abductor, hip flexor, hip extensor, buttocks and abdominal muscles.

SUMMARY OF THE INVENTION

The present invention comprises a simple multipurpose exercise device suitable for exercising all of the thigh abductor, thigh abductor, hip flexor, hip extensor, buttocks and abdominal muscles. An exercise device made in accordance with the present invention is capable of providing opposing resistance along a common line of action for exercising either of the thigh abductor or thigh abductor muscles and is also capable of providing resistance along two parallel, displaced paths for exercising the hip flexor, hip extensor, buttocks and abdominal muscles.

An exercise device incorporating features of the present invention, comprises a pair of side members each having a concave surface adapted to engage one of the thighs of a user. Each of the side members is supported in sliding engagement by a corresponding frame and operatively attached to a resilient member that urges the side member toward the open side of the concave surface. The frames can be fixed in various orientations. In one orientation of the frames, the side members face each other with the concave surfaces both opening inward. The user's legs are placed between the side members and moved apart against the urging of the resilient members to exercise the thigh abductor muscles. IN another orientation, the frames are oriented so that the side member face away from each other with the concave surfaces both opening outward. The device is placed between the user's legs and the user moves his/her legs together against the urging of the resilient members to exercise the thigh abductor muscles. In yet another orientation, the frames are oriented so that the side members are parallel and facing the same direction. The device in this configuration may be laid over the user's thighs with one side member resting on each thigh. A hip flexor exercise may be performed by lifting one leg at a time against the corresponding side member or the muscles of the abdomen may be exercised by bending forward to move the frames against the side members. The same frame orientation may be used to exercise the hip extensor and buttocks by placing the device under the user's thighs with one side member engaging the bottom of each of the user's thighs. With the frames firmly gripped by the user, the hip extensor and buttocks are exercised by moving the thigh downward against the moveable side members.

BRIEF DESCRIPTION OF THE DRAWING

The present invention will be better understood from a reading of the following detailed description, taken in conjunction with the accompanying drawing figures in which like references designate like elements and, in which.

DETAILED DESCRIPTION

Figure 1:
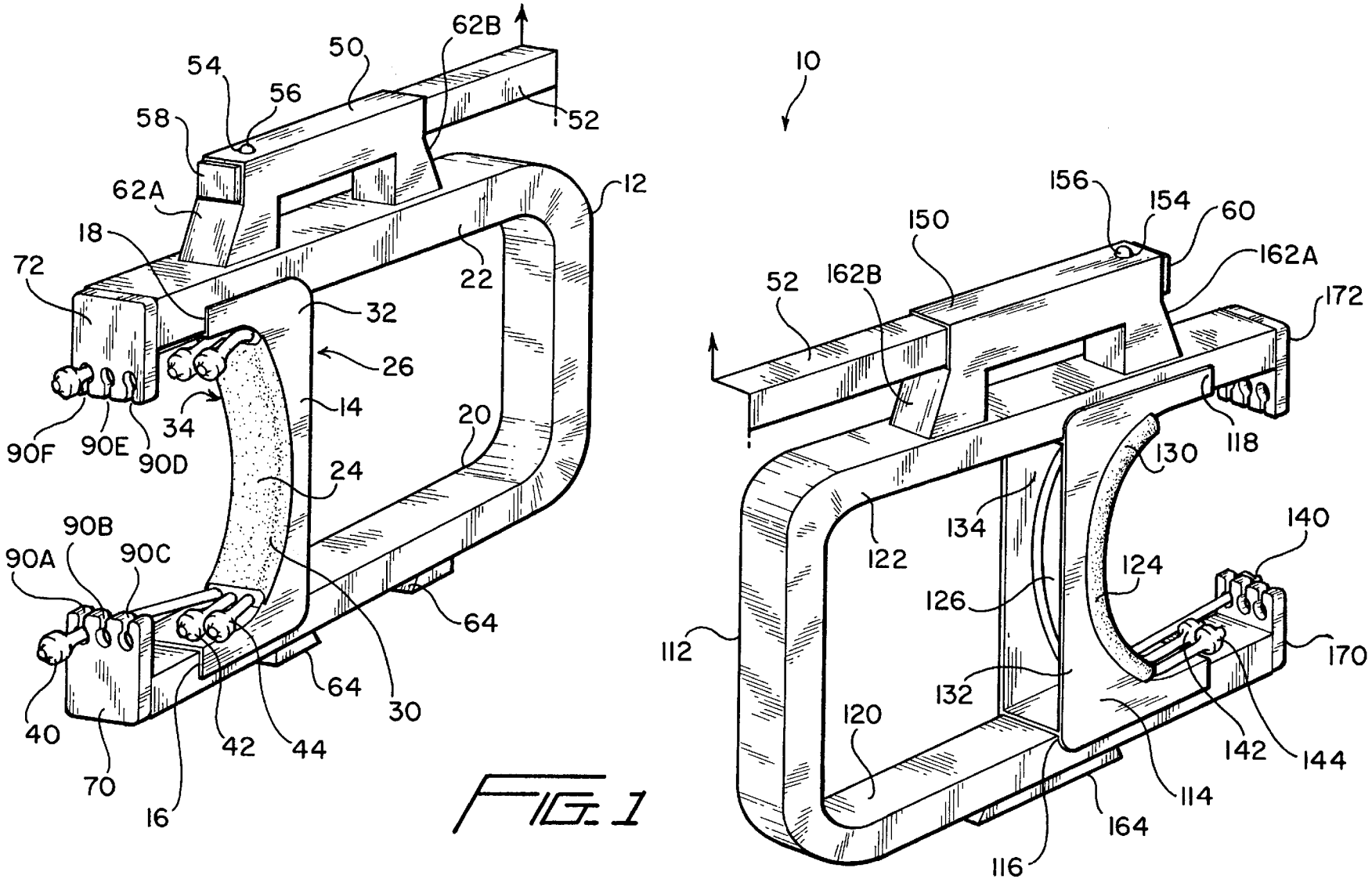
FIG. 1 is a perspective view of an embodiment of an exercise device incorporating features of the present invention.

The drawing figures are intended to illustrate the general manner of construction and are not to scale. In the description and in the claims the terms left, right, front and back and the like are used for descriptive purposes. However, it is understood that the embodiment of the invention described herein is capable of operation in other orientations than is shown and the terms so used are only for the purpose of describing relative positions and are interchangeable under appropriate circumstances.

With reference to FIG. 1, an exercise device 10 comprises a first frame 12 comprising a rectangular tube formed into a substantially "U" shape. Frame 12 is preferably made of lightweight steel tubing and is formed in a manner well known in the art. Side member 14 is disposed over frame 12, such that the channel sections 16, 18 of side member 14 are guided by legs 20, 22 of frame 12. Side member 14 is thereby constrained reciprocate along a path defined by legs 20, 22. Side member 14 is preferably formed of a polymer material having a concave surface 24 and a convex surface 26 (not shown). Concave surface 24 is preferably provided with a pad 30 to provide a comfortable surface for engaging a user's thigh. Convex surface 26 is bounded on both sides by side plates 32, 34 thereby forming a convex curved channel for retaining the resilient members 40, 42, 44, as discussed more fully hereinafter.

Frame 12 further comprises socket 50 adapted to receive a strut 52. Strut 52 is preferably formed from lightweight steel rectangular tubing and may be fitted with end plugs to provide a pleasing appearance. Socket 50 includes a transverse hole 54 therethrough. A conventional detent plunger 56 is incorporated into the end 58 of strut 52 to engage transverse hole 54 thereby securely fastening strut 52 to frame 12. Additional transverse holes (not shown) may be formed in socket 50 to allow for different insertion lengths and/or rotational orientations of strut 52 relative to socket 50. Socket 50 includes a pair of stand-offs 62A, 62B to permit socket 50 to double as a handle.

A second frame 112 comprising a rectangular tube formed into a substantially "U" shape. Frame 112 is preferably made of lightweight steel tubing and is formed in a manner well known in the art. Side member 114 is disposed over frame 112, such that the channel sections 116, 118 of side member 114 are guided by legs 120, 122 of frame 112. Side member 114 is thereby constrained reciprocate along a path defined by legs 120, 122. Side member 114 is preferably formed of a polymer material having a concave surface 124 and a convex surface 126. Concave surface 124 is preferably provided with a pad 130 to provide a comfortable surface for engaging a user's thigh. Convex surface 126 is bounded on both sides by side plates 132, 134 thereby forming a convex curved channel for retaining the resilient members 140, 142, 144.

Frame 112 further comprises socket 150 adapted to receive the end 60 of strut 52. Socket 150 includes a transverse hole 154 therethrough. A conventional detent plunger 156 is incorporated into the end 60 of strut 52 to engage transverse hole 154 thereby securely fastening strut 52 to frame 112. Additional transverse holes (not shown) may be formed in socket 150 to allow for different insertion lengths and/or rotational orientations of strut 52 relative to socket 150. Socket 150 includes a pair of stand-offs 162A, 162B to permit socket 150 to act as a handle.

Frame 12 is provided with a female dovetail 64. Frame 112 is provided with a male dovetail 164 adapted to engage female dovetail 64 for securing frame 112 to frame 12 for performing certain exercises as described more fully hereinafter.

Figure 2:
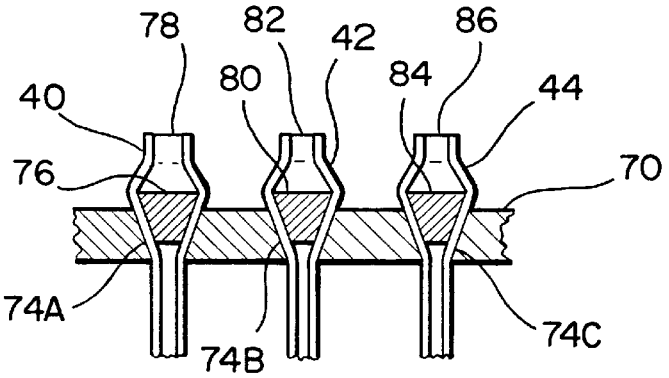
FIG. 2 is a detail cross-sectional view showing the resistance means of the embodiment of FIG. 1.

With reference to FIGS. 1 and 2, resilient members 40, 42, 44, 140, 142, 144 preferably comprise latex tubing, commonly used in the art for providing a lightweight highly elongatable resistance means. Resilient members 40, 42, 44, are each looped around the convex channel formed by surface 26 and side plates 32, 34. The ends of resilient members 40, 42, 44 are secured to belaying plates 70, 72 in a manner described with reference to FIG. 2 hereinafter. Similarly, resilient members 140, 142, 144 are each looped around the convex channel formed by surface 126 and side plates 132, 134. The ends of resilient members 140, 142, 144 are also secured to belaying plates 170, 172 in a manner described with reference to FIG. 2 hereinafter.

With reference specifically to FIG. 2, tapered plug 76 is inserted into open end 78 of resilient member 40 to enlarge end 78 such that end 78 will not pass through tapered hole 74 in belaying plate 70. The circumferential force of resilient member 40 retains tapered plug 76 inside resilient member 40. Resilient member 42 is similarly retained by inserting tapered plug 80 into end 82 of resilient member 42 to prevent end 82 from passing through tapered hole 74B and resilient member 44 is retained by tapered plug 84 inserted into end 86 of resilient member 44 to prevent end 86 from passing through tapered hole 74C. The free ends of resilient members 40, 42, 44, are similarly retained in belaying plate 72. The ends of resilient members 140, 142, 144 are similarly retained in corresponding belaying plates 170, 172. Belaying plates 70, 72, are provided with slots 90A, 90B, 90C, 90D, 90E, 90F to permit resilient members 40, 42, 44 to be selectively attached to or detached from belaying plates 70, 72 to vary the resistance. Resilient members 40, 42, 44 may be of equal spring rates, but preferably are of different spring rates K1, K2, and K3, such that with three resilient members, a total of 7 different spring rates can be achieved. Similarly, belaying plates 170, 172 are, are provided with slots 190A, 190B, 190C, 190D, 190E, 190F to permit resilient members 140, 142, 144 to be selectively attached to or detached from belaying plates 170, 172 to vary the resistance. Fewer or greater than three resilient members acting on a given side member may be incorporated into any given design to accommodate the need for coarser or finer adjustments of resistance without departing from the scope of the invention. Moreover, although latex tubing is used in the illustrative embodiment, other resilient members such as helical compression or extension springs may be substituted without departing from the scope of the present invention.

Figure 3:
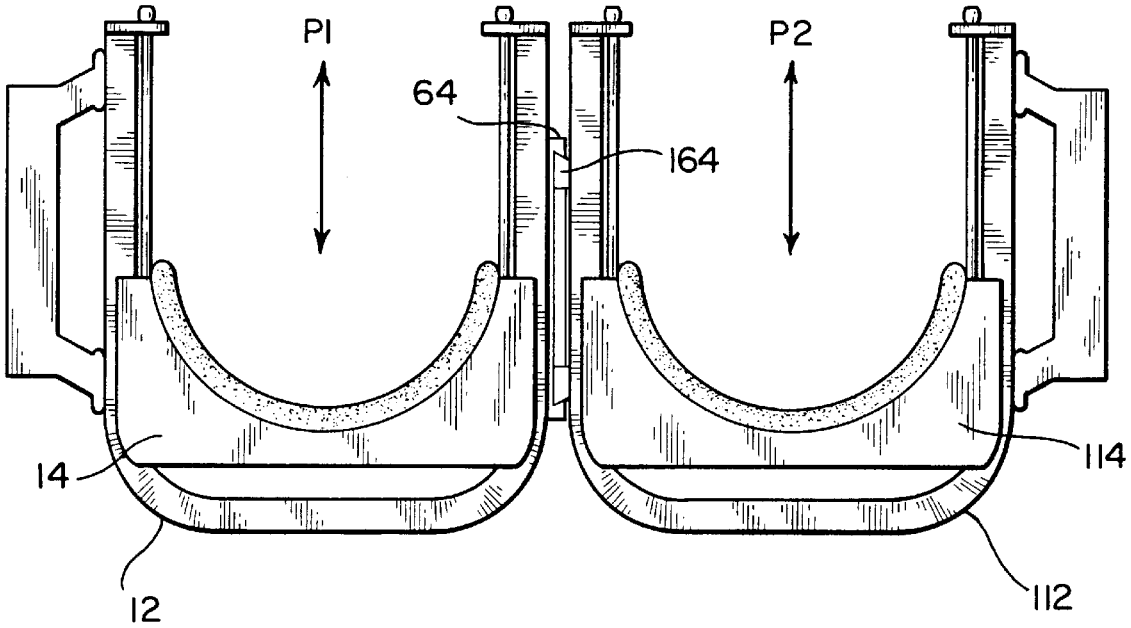
FIG. 3 is a plan view of the embodiment of FIG. 1 configured with the side members parallel.
Figure 4:
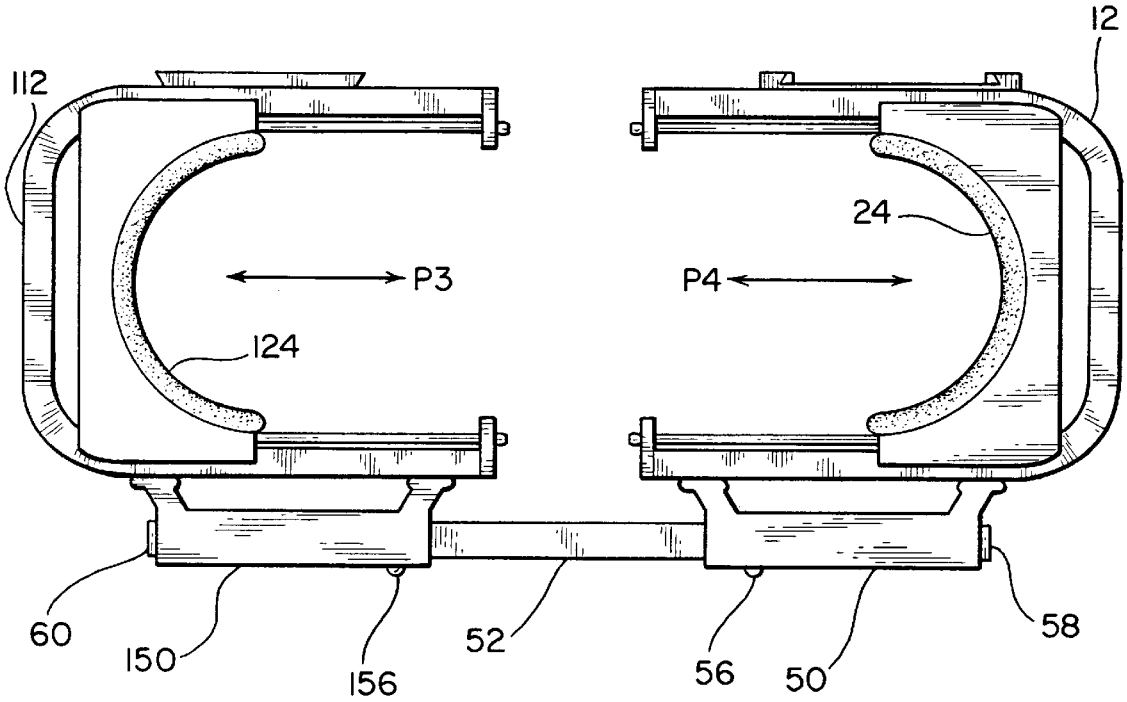
FIG. 4 is a plan view of the embodiment of FIG. 1 configured with the side members moving along a substantially co-linear path with concave surfaces facing inward.
Figure 5:
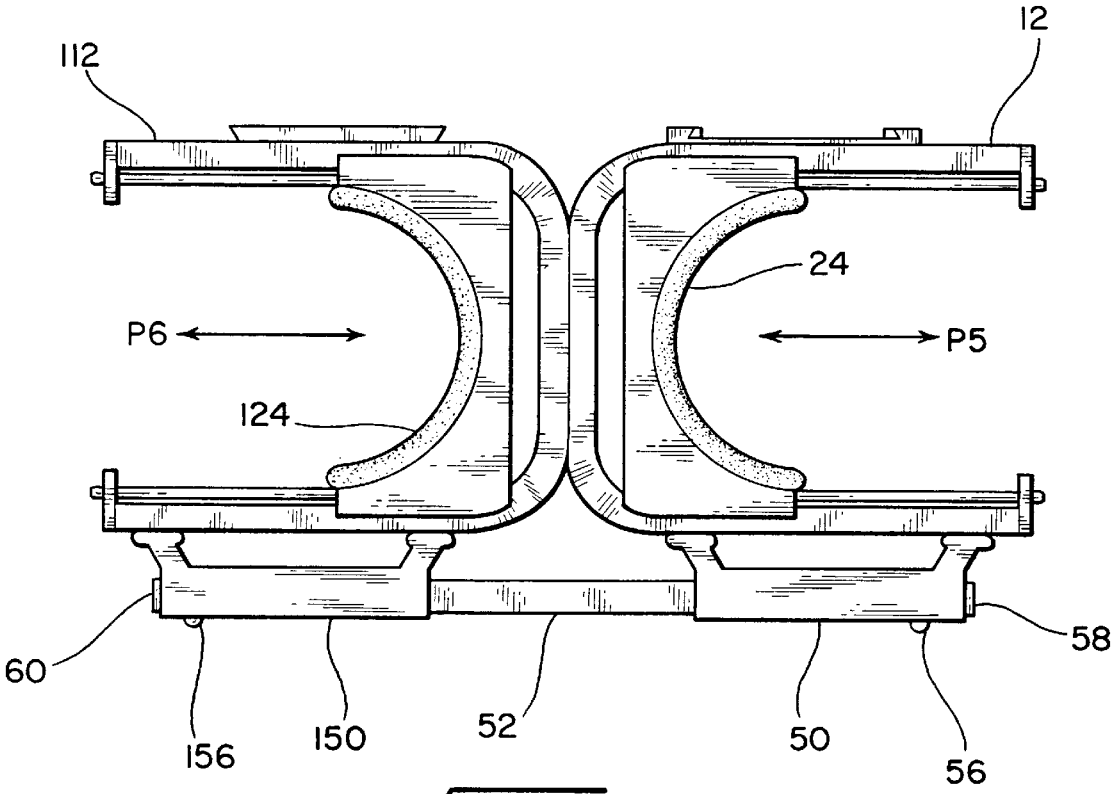
FIG. 5 is a plan view of the embodiment of FIG. 1 configured with the side members moving along a substantially co-linear path with concave surfaces facing outward.
Figure 6:
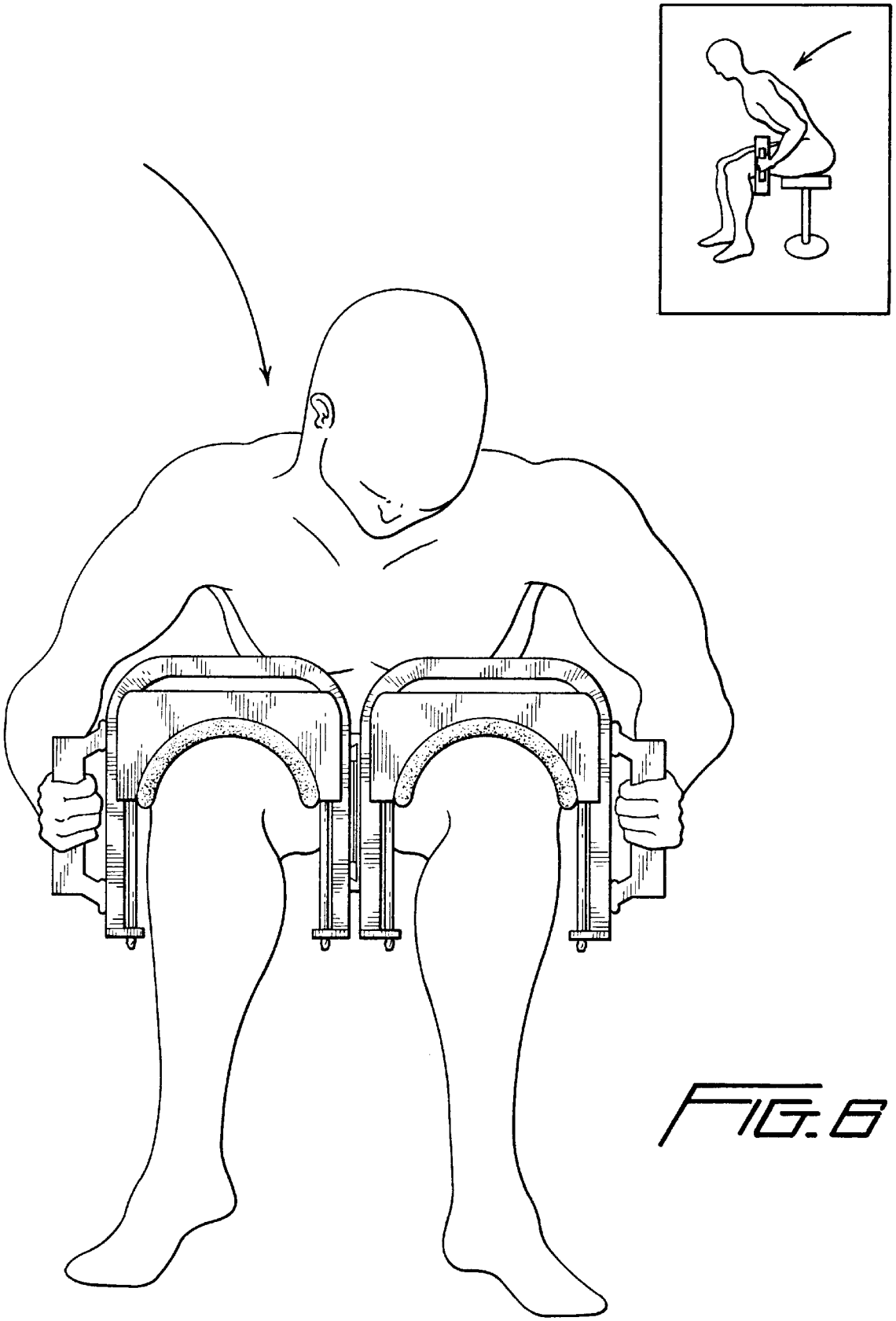
FIG. 6 illustrates the embodiment of FIG. 1 being used to perform an abdominal crunch.
Figure 8:
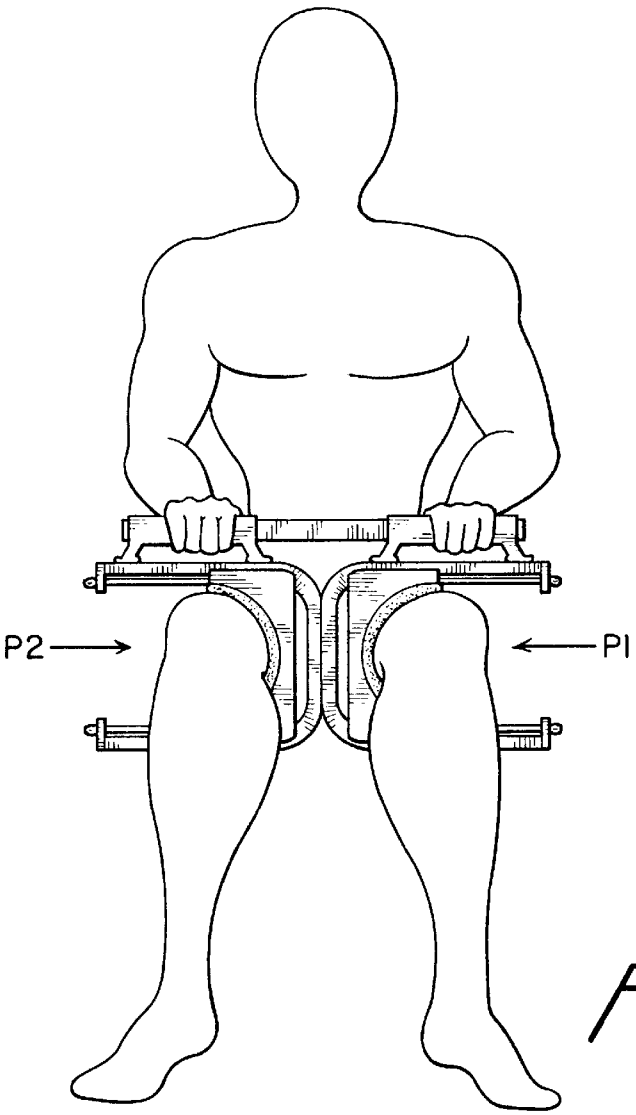
FIG. 8 illustrates the embodiment of FIG. 1 being used to exercise the thigh abductor muscles.
Figure 7:
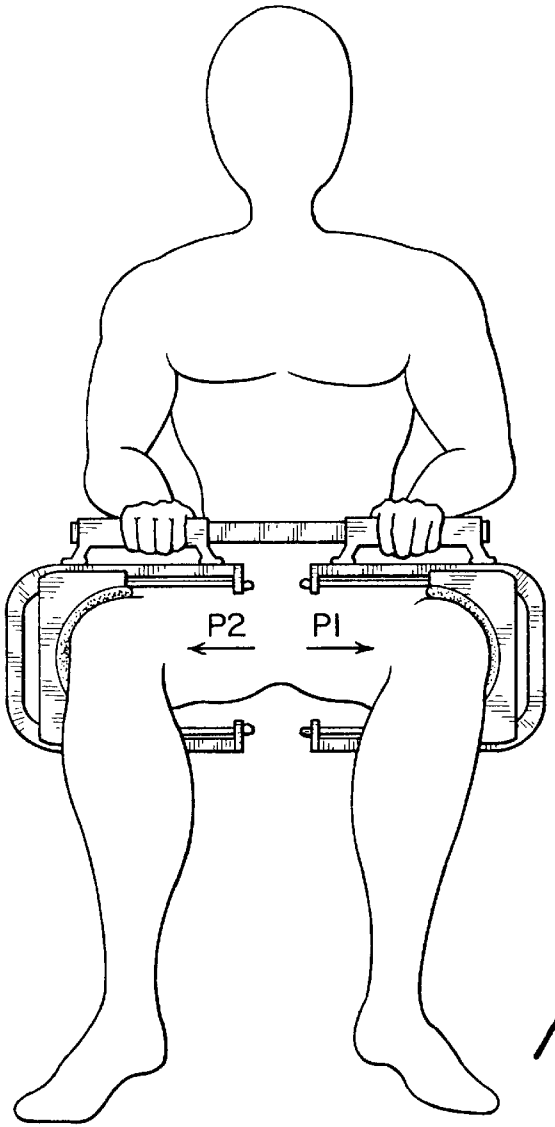
FIG. 7 illustrates the embodiment of FIG. 1 being used to exercise the thigh abductor muscles.

For performing stomach crunches as shown in FIG. 6, or for exercising the hip flexor, extensor, etc., frame 12 and frame 112 are oriented as shown in FIG. 3, such that side member 14 and side member 144 move in substantially parallel paths P1 and P2 respectively. The parallel paths P1 and P2 are displaced horizontally by a distance approximately equal to the width of one of frames 12 or 112. Frames 12 and 112 are maintained in the parallel orientation by the engagement of female dovetail 64 with male dovetail 164. For performing hip abductor exercises as shown in FIG. 7, frame 12 and frame 112 are oriented as shown in FIG. 4, such that side member 14 and side member 144 move in substantially co-linear paths P3 and P4, respectively, with concave surfaces 24 and 124 facing toward each other. Frame 12 and frame 112 are secured in the orientation shown in FIG. 4 by strut 52, end 58 of which is inserted into socket 50 and end 60 of which is inserted into socket 150. Detent plungers 56 and 156 lock strut 52 in position to hold frames 12 and 112 rigidly in position. For performing hip abductor exercises as shown in FIG. 8, frame 12 and frame 112 are oriented as shown in FIG. 5, such that side member 14 and side member 144 move in substantially co-linear paths P5 and P6, respectively, with concave surfaces 24 and 124 facing away from each other. Frame 12 and frame 112 are secured in the orientation shown in FIG. 5 by strut 52, end 58 of which is inserted into socket 50 and end 60 of which is inserted into socket 150. Detent plungers 56 and 156 lock strut 52 position to hold frames 12 and 112 rigidly in position.

Figure 9:
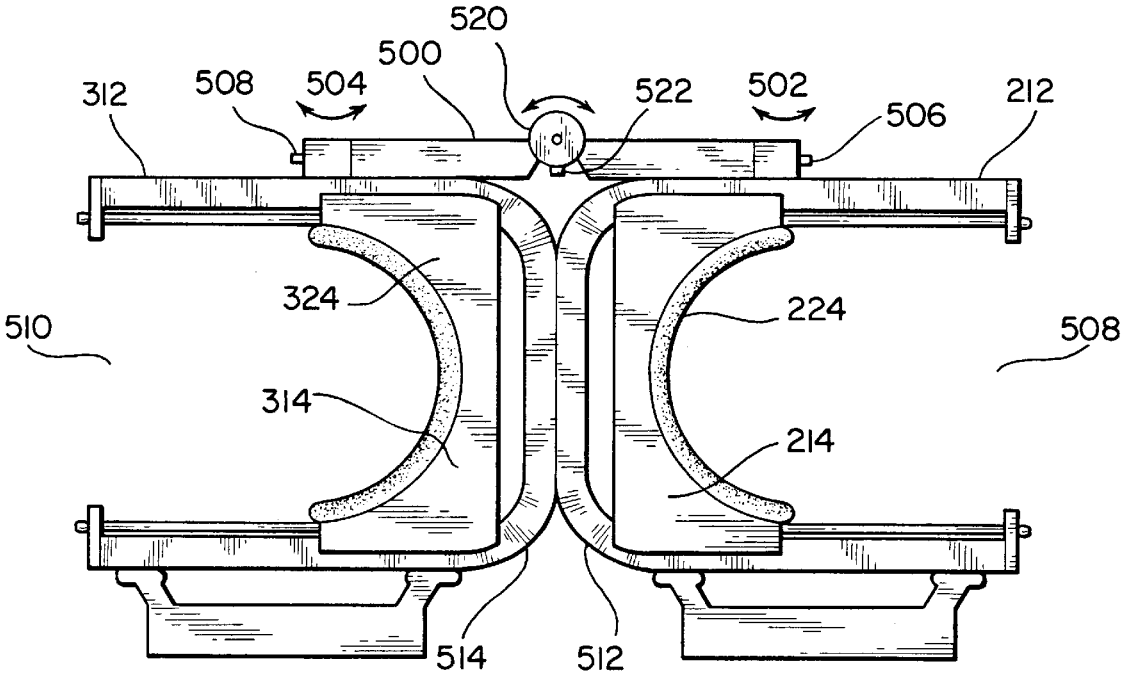
FIG. 9 is a plan view of an alternative embodiment incorporating features of the present invention.
Figure 10:
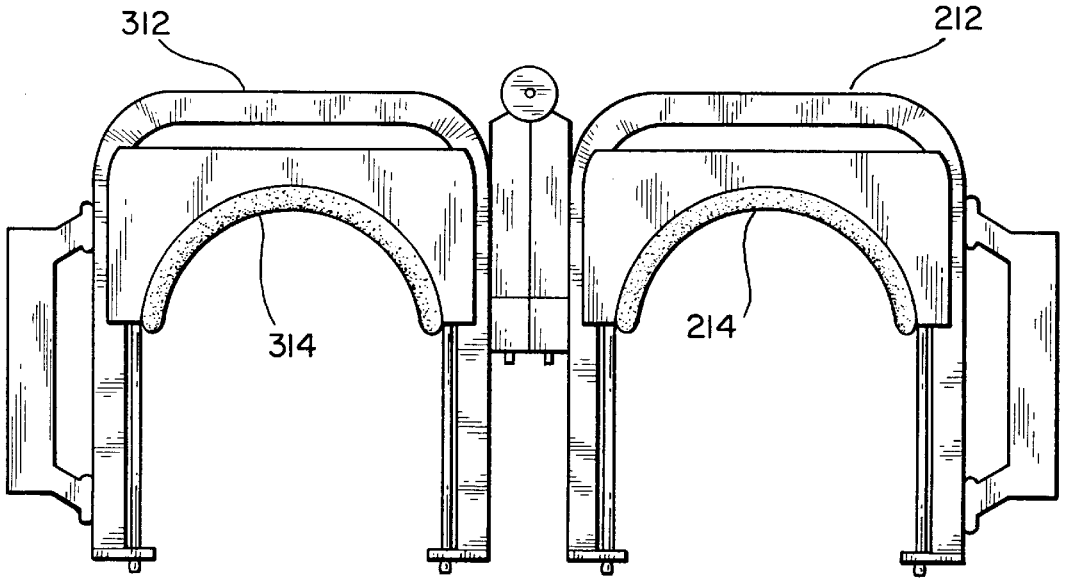
FIG. 10 is a plan view of the embodiment of FIG. 9 in a second orientation.

With reference to FIGS. 9 and 10, an alternative embodiment of a multipurpose exercise device incorporating features of the present invention includes frame 212 and frame 312 each with moveable side members 214 and 314 respectively, each of which move against a resistance mechanism in the manner discussed with reference to the embodiment of FIG. 1. In the embodiment of FIGS. 9 and 10, frame 212 and frame 312 are pivotally attached to folding arm 500 by end pivots 502 and 504 respectively. Locking detents 506 and 508 respectively lock frames 212 and 312 in the orientation shown in FIG. 9 with concave surfaces 224 and 324 facing away from each other or in an orientation (not shown) with concave surfaces 224 and 324 facing each other. Preferably, pivots 502 and 504 are closer to open ends 508 and 510 of frames 212 and 312 than they are to closed ends 512 and 514, such that when rotated into the orientation in which concave surfaces 223 and 324 are facing each other, open ends 508 and 510 are spaced-apart (as shown in FIG. 4) to permit a more comfortable positioning of the apparatus 10 over the user's legs.

As shown in FIG. 10, folding arm 500 is pivotable about a third pivot 520 having an axis orthogonal to the axes of pivots 502 and 504. A locking detent 522 locks pivot 520 alternatively in the position shown in FIG. 9, with folding arm 500 essentially straight, and in the position shown in FIG. 10 with folding arm 500 folded flat against itself.

Although certain preferred embodiments and methods have been disclosed herein, it will be apparent from the foregoing disclosure to those skilled in the art that variations and modifications of such embodiments and methods may be made without departing from the spirit and scope of the invention. Accordingly, it is intended that the invention shall be limited only to the extent required by the appended claims and the rules and principles of applicable law.

What is claimed is:

1. A portable exercise device comprising:

A first frame, said first frame comprising a "U" shaped bracket having an open end;

A first moveable side member slidingly engaging said first frame, said first moveable side member comprising a concave surface adapted to comfortably engage a user's thigh;

A first resilient member operatively engaged between said first frame and said first moveable side member for urging said first moveable side member toward said open end of said first frame.

2. The portable exercise device of claim 1 further comprising:

A second frame, said second frame comprising a "U" shaped bracket having an open end;

A second moveable side member slidingly engaging said second frame, said second moveable side member comprising a concave surface adapted to comfortably engage a user's thigh;

A second resilient member operatively engaged between said second frame and said second moveable side member for urging said second moveable side member toward said open end of said second frame.

3. The portable exercise device of claim 2 further comprising:

A coupling member capable of attaching said first frame to said second frame in a first orientation in which said first and second moveable side members are moveable along a substantially co-linear path urged in opposite directions.

4. The portable exercise device of claim 3, wherein:

said coupling member is capable of attaching said first frame to said second frame in a second orientation in which said moveable side members are moveable along substantially parallel paths.

5. The portable exercise device of claim 3 wherein:

said moveable side members are urged toward each other.

6. The portable exercise device of claim 3, wherein:

said moveable side members are urged away from each other.

7. The portable exercise device of claim 3, further comprising:

a second coupling member for attaching said first frame to said second frame in a third orientation in which said moveable side members move along substantially parallel paths.

8. A portable exercise device comprising:

A first frame having a first end and second end;

A first moveable side member slidingly engaging said first frame;

A first resilient member operatively engaged between said first frame and said first moveable side member for urging said first moveable side member toward said first end of said first frame;

A second frame also having a first end and a second end;

A second moveable side member slidingly engaging said second frame;

A second resilient member operatively engaged between said second frame and said second moveable side member for urging said second moveable side member toward said first end of said second frame;

Coupling means for attaching said first frame to said second frame in a first orientation in which said first and second moveable side members are moveable along a common, substantially co-linear path with said first end of said first frame being proximal said first end of said second frame, and in a second orientation in which said side members are moveable along a common, substantially co-linear path with said second end of said first frame being proximal said second end of said second frame.

9. The portable exercised device of claim 8 wherein:

Said coupling means further comprise means for attaching said first frame to said second frame in a third orientation in which said moveable side members are moveable along substantially parallel paths.

10. The portable exercise device of claim 8 further comprising:

Third and fourth resilient members, said third and fourth resilient members being selectively attachable to said first and second moveable side members, respectively, to provide additional force for urging said first and second moveable side members toward said first ends of said first and second frames.

11. The portable exercise device of claim 10 wherein:

Said resilient members comprise elastic tubing.

12. The portable exercise device of claim 10 wherein:

Said resilient members comprise extension springs.

13. A portable exercise device comprising:

A first frame;

A first moveable side member slidingly engaging said first frame, said first moveable side member comprising a first concave surface opening outwardly to define a first direction;

A first resilient member operatively engaged between said first frame and said first moveable side member for urging said first moveable side member in said first direction.

14. The portable exercise device of claim 13 further comprising:

A second frame;

A second moveable side member slidingly engaging said second frame, said second moveable side member comprising a second concave surface opening outwardly to define a second direction;

A second resilient member operatively engaged between said second frame and said second moveable side member for urging said second moveable side member in said second direction.

15. The portable exercise device of claim 14 further comprising:

A coupling member capable of attaching said first frame to said second frame in a first orientation in which said first and second moveable side members are moveable along a substantially co-linear path urged in opposite directions with said first and second concave surfaces opening toward each other and in a second orientation in which said first and second moveable side members are moveable along a substantially co-linear path urged in opposite directions with said first and second concave surfaces opening away from each other.

16. The portable exercise device of claim 15, wherein:

said coupling member is capable of attaching said first frame to said second frame in a third orientation in which said moveable side members are moveable along substantially parallel paths.

17. The portable exercise device of claim 15 further comprising:

a second coupling member adapted to attach said first frame to said second frame in a third orientation in which said movable side members are moveable along substantially parallel paths.

* * * * *